US010322441B2

(12) United States Patent
Lauer

(10) Patent No.: US 10,322,441 B2
(45) Date of Patent: Jun. 18, 2019

(54) HAND TOOL FOR BENDING REBAR

(71) Applicant: Lauer Industries, LLC, Honolulu, HI (US)

(72) Inventor: Manuel David Lauer, Honolulu, HI (US)

( * ) Notice: Subject to any disclaimer, the term of this patent is extended or adjusted under 35 U.S.C. 154(b) by 618 days.

(21) Appl. No.: 14/994,429

(22) Filed: Jan. 13, 2016

(65) Prior Publication Data

US 2017/0197238 A1 Jul. 13, 2017

(51) Int. Cl.
*B21D 11/12* (2006.01)
*B21D 11/10* (2006.01)

(52) U.S. Cl.
CPC ..... *B21D 11/12* (2013.01); *B21D 11/10* (2013.01)

(58) Field of Classification Search
CPC ..... B21D 11/10; B21D 11/12; B25B 23/0028; B25B 23/0014; B25B 23/0035
See application file for complete search history.

(56) References Cited

U.S. PATENT DOCUMENTS 2,732,743 A * 1/1956 Hart ..... B21D 7/063 72/458
3,824,834 A * 7/1974 Durham ..... B21D 7/024 72/387
4,406,186 A * 9/1983 Gummow ..... B25B 13/465 81/177.8
8,631,674 B2 * 1/2014 Christofilis ..... B21D 7/12 72/306
2009/0145268 A1 * 6/2009 Laurie ..... B25B 23/0014 81/60

OTHER PUBLICATIONS

TEKTON Ratchet, 1/2 inch drive and 24 inch long; https://www.amazon.com/TEKTON-15013-24-Inch-Ratchet-72-Tooth/dp/B00DPLNL8Y?pd_rd_wg=tXg7f&pd_rd_r=f405a7ff-e199-4131-bdf5-848287b7456a&pd_rd_w=0B4vi&ref_=pd_gw_simh&pf_rd_r=WJDEKN0Y6MRM7JV7FWFB&pf_rd_p=b841581f-e864-5164-afa6-4c18a8348879.*

GreenLee Webpage advertisement for Bender-Cable-Ratchet product. http://www.greenlee.com/products/BENDER%2540dCABLE-RATCHET-(796).html?product_id=15475.

Amazon online ad for HK Porter RB4 3/8-Inch No. 3 and 1/2-Inch No. 4 Extendable Indexing Rebar Bender, Red/Black. http://www.amazon.com/gp/product/B0091KHN2S/ref=pd_lpo_sbs_dp_ss_2?pf_rd_p=1944687722&pf_rd_s=lpo-top-stripe-1&pf_rd_t=201&pf_rd_i=B000IMVVV2K&pf_rd_m=ATVPDKIKX0DER&pf_rd_r=1P5CP3FE379KVDM3Y1D4.

* cited by examiner

*Primary Examiner* — Pradeep C Battula

(57) ABSTRACT

A ratcheting hand tool (or "Hickey bar") for bending rebar comprising a ratchet mechanism, a handle attached to the ratchet mechanism, and a Hickey bar tool head attached to the ratchet mechanism, which tool head may be a detachable.

18 Claims, 5 Drawing Sheets

HAND TOOL FOR BENDING REBAR

TECHNICAL FIELD

The present invention relates to tools used to bend rebar and other long and slender objects.

BACKGROUND OF THE INVENTION

Rebar (short for reinforcing bar) is a steel bar used to reinforce concrete and masonry structures. Rebar's surface is often patterned to form a better bond with the concrete. Straight lengths of rebar must often be bent into desired shapes at a shop or project site.

A hand tool known as a "Hickey bar" or "Hickey" is commonly used by construction tradesmen to manually bend rebar. Hickeys have a tool head for engaging the rebar and a long handle for applying force necessary to make the bend. The tool head and handle are typically rigidly connected. The handle is long to provide a long lever arm so that greater bending moments (or torque) can be achieved with manual strength.

"Bending moment" and "torque" may be used interchangeably herein to indicate static or dynamic rotational forces at the tool head created by manually applied forces on the Hickey handle. The term "axis" with respect to bending moment or torque refers generally to the torque axis, whether it is static or dynamic. The axis of rotation of a Hickey bar or tool head is considered herein to be coincident with the torque axis for purposes of describing the invention. The bend of the rebar will generally be in a plane that is perpendicular to the torque axis. The term "bend axis" may be used to characterize the axis of a bend radius, which bend axis is considered herein to be parallel to the torque axis.

A typical pin type of Hickey is shown FIGS. 5*a* and 5*b*, the tool head of which typically has three pins. The straight rebar is placed in the space between the pins, with one pin on one side of the rebar and two pins on the other side. A three-pin Hickey provides three placement options, so that the Hickey handle may be oriented in one of three orientations relative to the rebar.

Another popular type of Hickey is shown in FIGS. 6*a* and 6*b*, which has a U-shaped tool head for engaging the rebar and which provides only one possible orientation of the handle to the rebar.

There is a need for a Hickey that provides a greater range of possible handle orientations so that tradesmen can position the Hickey handle in more advantageous orientations, so as to provide improved ergonomics, better leverage, less injury, and improved access to and maneuverability in tight spaces. There is a need for a Hickey that allows adjustment of the handle orientation without disengagement of the tool head from the rebar, so that a bend can be made in increments and the handle can be optimally positioned for each increment according to the preferences of the tradesman or according to other parameters such as workspace restrictions.

The present invention fills those and other needs.

SUMMARY OF THE INVENTION

In a first aspect, the present invention provides a hand tool for bending rebar, comprising: a ratchet mechanism; a handle extending from the ratchet mechanism; and a hickey tool head connected to the ratchet mechanism. The tool head comprises at least one engagement surface for engaging rebar. The at least one surface forms a space for receiving the rebar.

In a second aspect, the present invention provides a tool head for a rebar bending tool, comprising: a base adapted for attachment to a drive; and at least one engagement surface for engaging rebar and transmitting torque to the rebar. The at least one surface forms a transverse space for receiving the rebar in a transverse orientation to the torque axis.

In a third aspect, the present invention provides a tool for bending rebar, comprising: a base adapted for attachment to a driving device; a plurality of spaced apart extensions extending from the base so as to form a plurality of transverse spaces for receiving rebar; a ratchet mechanism releasably attachable to the base; and a handle attached to the ratchet device. The plurality of spaces comprise a first space having a first width to fit over rebar of a first standard rebar diameter and second space having a second width to fit over rebar of a second standard rebar diameter.

In a fourth aspect, the present invention provides a method of manufacturing a hickey bar tool head, comprising the steps of: machining into a block at least one transverse channel for receiving a rebar; and machining into the same block surfaces for engagement with a drive mechanism.

In a fifth aspect, the present invention provides method of bending rebar, comprising the steps of: engaging a ratcheting hickey bar with the rebar; applying torque to the hickey bar in the locked direction of the ratchet wherein the rebar bends as the hickey bar handle and the head rotate from a first position to a second position in response to the torque In a sixth aspect, the present invention provides a tool kit comprising at least one Hickey bar tool head and at least one ratchet mechanism compatible for connection with at least one of the at least one tool head.

BRIEF DESCRIPTION OF THE DRAWINGS

The subject matter that is regarded as the invention is particularly pointed out and distinctly claimed in the concluding portion of the specification. The invention, however, may be best understood by reference to the following detailed description of various embodiments and the accompanying drawings in which:

DETAILED DESCRIPTION OF THE INVENTION

With reference to FIGS. 1 and 2*a*-2*d*, a preferred embodiment of the present invention comprises handle 10 attached to ratchet mechanism 20 attached to tool head 30. The ratchet mechanism, like those typical of many commercially available ratcheting socket wrenches, has operational modes in which the drive is locked relative to the handle in one rotational direction and free to turn relative to the handle in the opposite direction. The operational modes can be easily switched from one direction to the other. In the embodiment of FIG. 2*a*-2*d*, a switch lever 21 is provided to change the ratchet mode between locked-clockwise and locked-counterclockwise. Other ratchet modes may include locked in both directions and free in both directions. The Hickey bar and rebar need not be disengaged to switch modes.

Certain embodiments of the present invention may comprise commercially available ratchet mechanisms and tool heads constructed to be compatible with commercially available ratchet mechanisms. Other embodiments may comprise ratchet mechanisms specifically designed for Hickey bar application and for the high loads necessary to bend rebar.

An example of a commercially available female ratchet drive is Proto® Industrial Tools item number J5649FW ¾" Ratchet Female Drive with 20" handle, and an example of a commercially available male ratchet drive is Snap-On® item L873 1" Square Drive Sealed Ratchet Head. There are many others.

Figure 1:
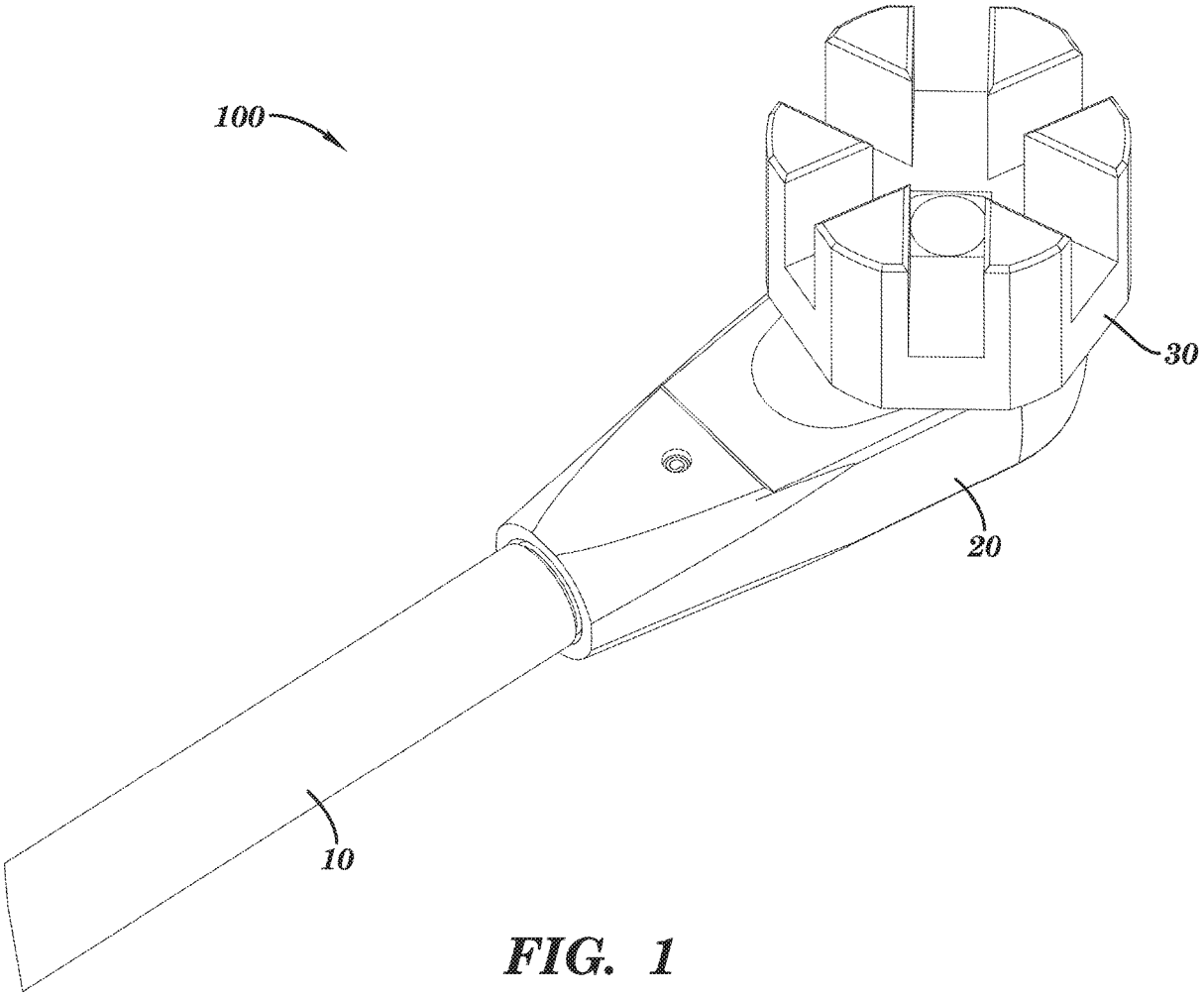
FIG. 1 is a perspective view of one embodiment of a Hickey bar in accordance with the present invention, with only part of the handle length showing.
Figure 2B:
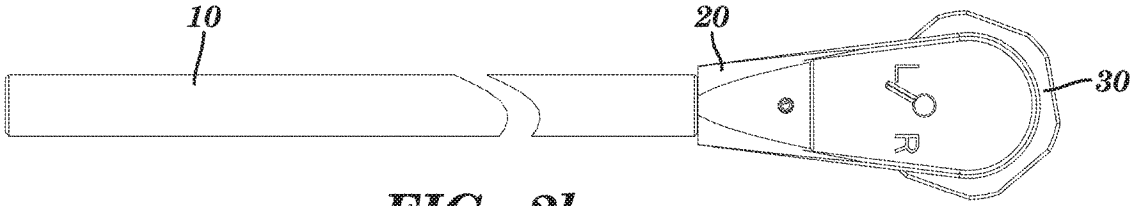
FIG. 2*b* is a top view of the Hickey bar of FIG. 2*a;*
Figure 2A:
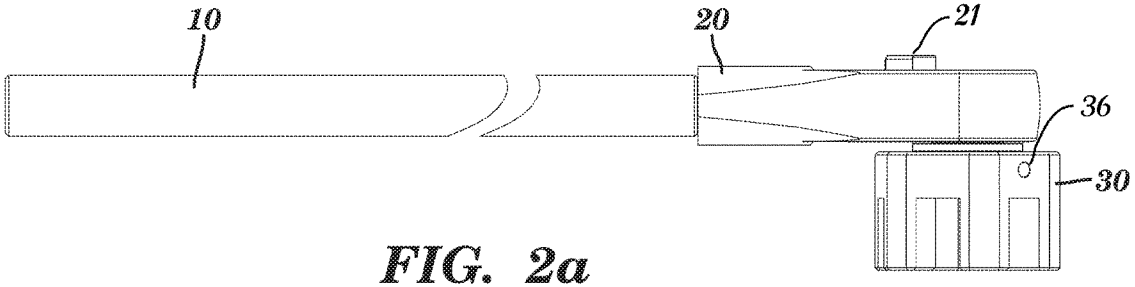
FIG. 2*a* is a side view of the Hickey bar of FIG. 1 with the handle length shown in broken view.
Figure 2D:
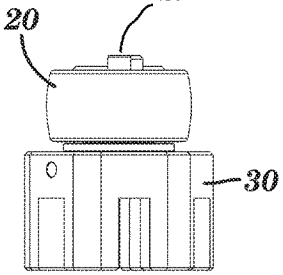
FIG. 2*d* is an end view of the Hickey bar of FIG. 2*a;*
Figure 2C:
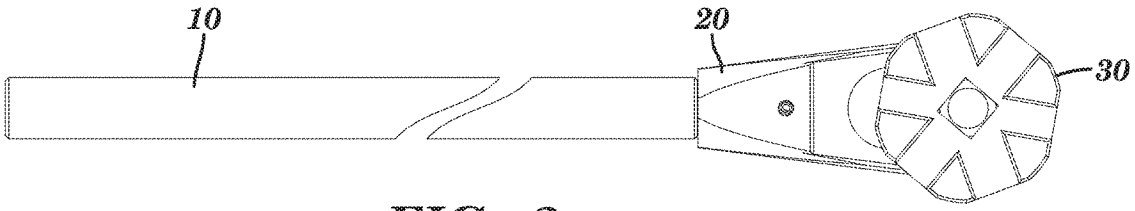
FIG. 2*c* is a bottom view of the Hickey bar of FIG. 2*a;*
Figure 2E:
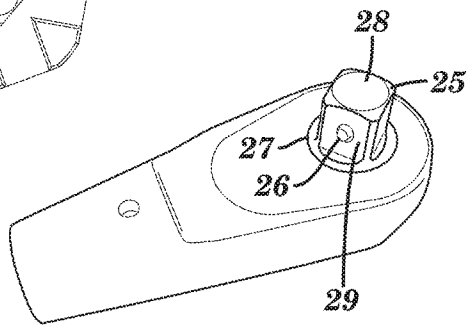
FIG. 2*e* is a perspective view of an embodiment of a ratchet mechanism that may be utilized in an embodiment of the present invention.

With reference to FIG. 2*e*, the drive portion of a typical commercially available ratchet mechanism is shown, having a square drive peg 25. Drive peg 25 has lateral sides 29, beveled top edges and corners forming round top surface 28, a round shoulder 27 at the base of the peg, and a releasable lock pin 26 or equivalent lock ball for engaging a corresponding hole or indentation in the tool head. The peg's longitudinal axis corresponds with its axis of rotation when it rotates relative to the Hickey bar handle. The "drive axis" or "axis of rotation" may refer to the axis of rotation of a male drive ratchet or female drive ratchet relative to the handle. The tool head of the present invention may be configured to be releasably attachable to the drive in like manner as sockets are in commercially available ratcheting socket wrench sets, and may comprise a hole or indentation in the tool head for receiving releasable lock pin 26 or equivalent lock ball.

Figure 3A:
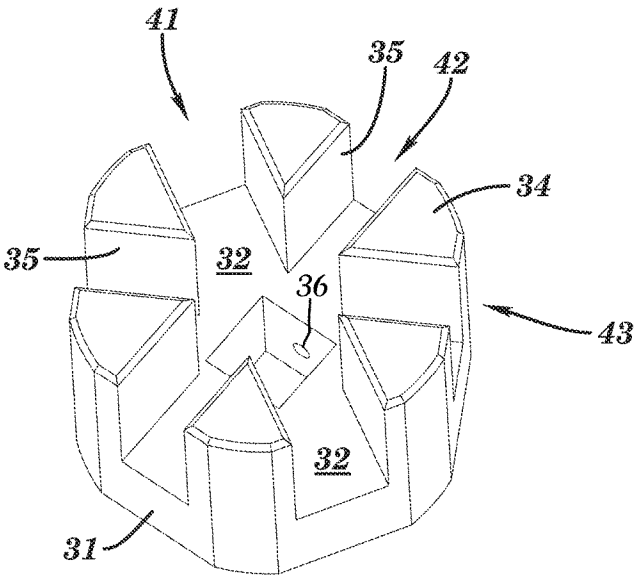
FIG. 3*a* is a perspective view of the tool head of the Hickey bar of FIG. 1.

In another embodiment of the present invention, the tool head is securely fastened to the drive peg using any suitable manner for secure attachment, such as a pinned joint. With reference to FIGS. 2*a* and 3*a*, tool head 30 may be provided with a pin hole 36. The drive peg may be provided with a corresponding pin hole (not shown) aligned with pin hole 36. A pin (not shown) may be installed in the pin holes, said pin having an interference fit with the holes, to form a secure joint. This embodiment may comprise a drive without a releasable lock means such as a releasable pin 26 or equivalent releasable ball. Such a non-releasable joint may be preferred to ensure robust connection and prevent inadvertent release of the tool head from the ratchet mechanism under the rigorous loading conditions often encountered in service.

In other embodiments, the present invention may comprise fixed drives with no ratchet mechanism. In yet other embodiments, the tool head may be integral to the drive and may be integral to the handle.

Figure 3C:
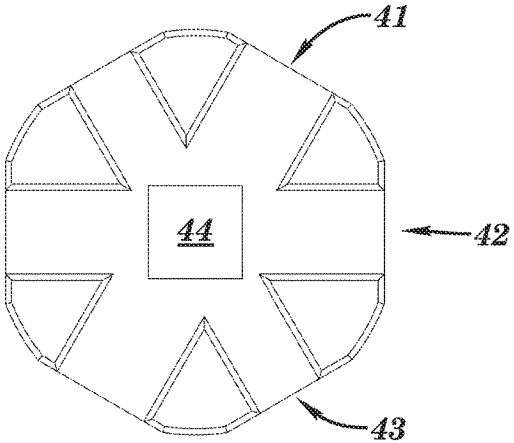
FIG. 3*c* is a top view of the tool head of FIG. 3*b;*
Figure 3B:
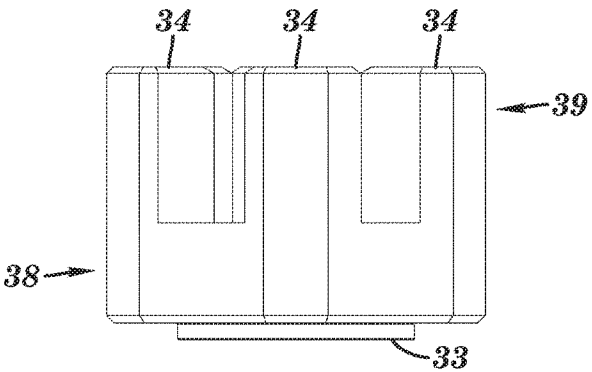
FIG. 3*b* is a side view of the tool head of FIG. 3*a;*

With reference to FIGS. 3*a*-3*c*, a preferred embodiment of the tool head may comprise a base 31 having upward facing surface 32 and a plurality of upwardly extending members 34 having lateral sides 35. The spaces between sides 35 of members 34 form transverse channels 41, 42 and 43, each channel extending across the tool head. Each member 34 may have different dimensions than other members 34 as necessary to form channels of desired width. In FIG. 3*c*, channel 41 is wider than channel 42, and channel 42 is wider than channel 43. Member 34 between channels 41 and 42 has a smaller cross section than the member between channels 42 and 43.

The tool head may comprise a spacer 33 extending below base 31, said spacer for contacting the ratchet drive and maintaining clearance between the base and ratchet mechanism.

The tool head of the present invention may be manufactured from a block by machining away the material necessary to form channels of desired dimension. Thus, members 34 are formed from remaining material of the block between the channels, as shown in FIG. 3*a*. Thus the present invention provides for improved manufacturing methods. Most efficient use of materials is achieved, which allows for smaller tool heads and provides stronger upward extending members 34. Side surfaces 35 of members 34 contact the rebar during bending operations and transmit the bending torque to the rebar. Members 34 and surfaces 35 have material properties sufficient to withstand these forces without undue deformation.

In some embodiments, the channels may comprise a round hole bored transversely through the tool head. The hole may be manufactured in any desirable cross sectional shape. In those embodiments, the channels are not open to the top of the tool head.

Figures 5A, 5B, 6A, 6B:
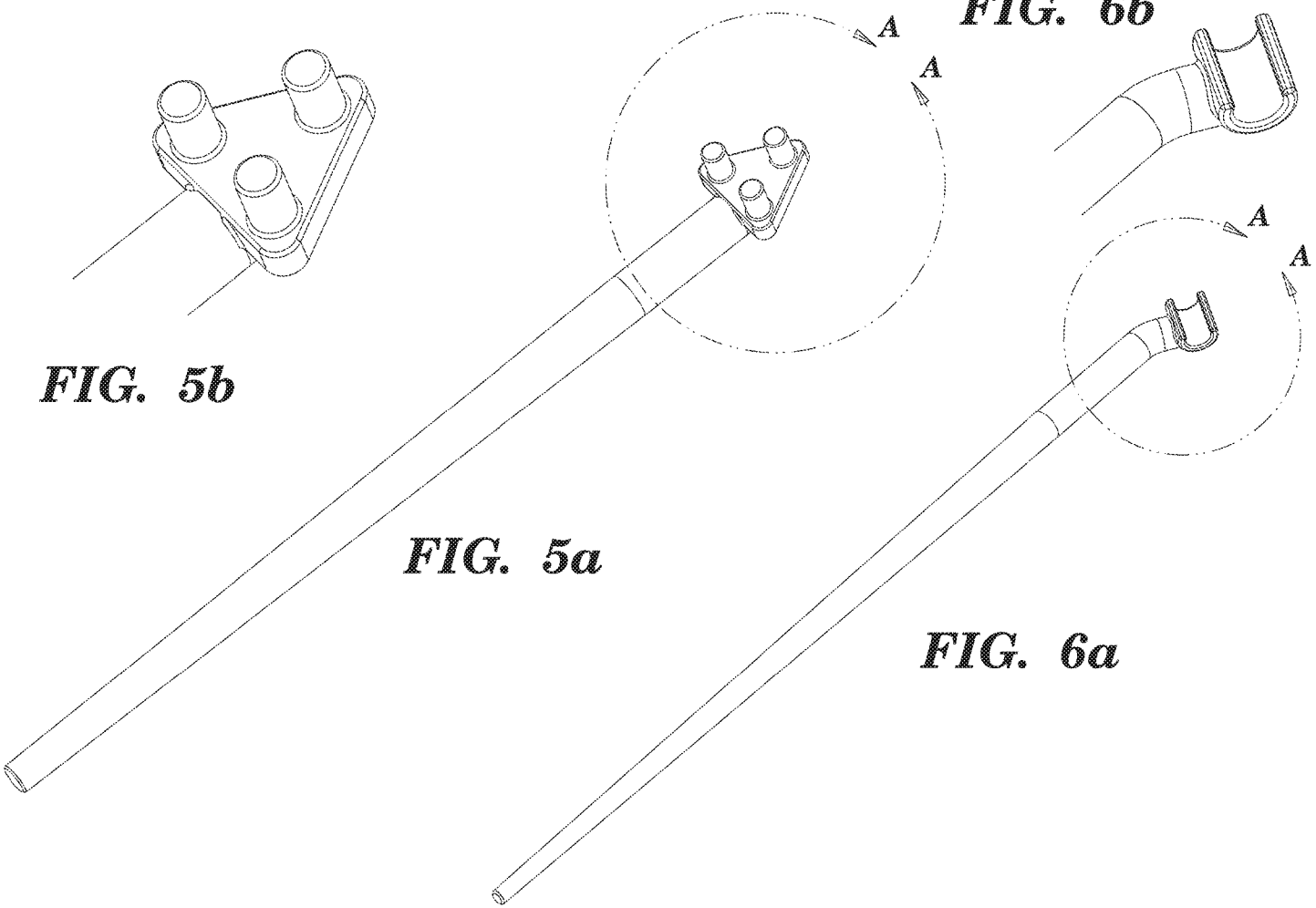
FIG. 5*a* is a perspective view of a type of Hickey bar of the prior art.
FIG. 5*b* is an enlarged view of the portion of FIG. 5*a* identified by line A-A in FIG. 5*a;*
FIG. 6*a* is a perspective view of another type of Hickey bar of the prior art.
FIG. 6*b* is an enlarged view of the portion of FIG. 6*a* identified by line A-A in FIG. 6*a*.

The tool head of the present invention may comprise a single piece of material, thus providing a more robust tool head and eliminating assembly steps such as assembling pins to the tool head as may be necessary for the Hickey bar of FIG. 5*a*.

The tool head may comprise metal or any other suitable material. The tool head may comprise steel and may comprise tool steel.

Figure 4B:
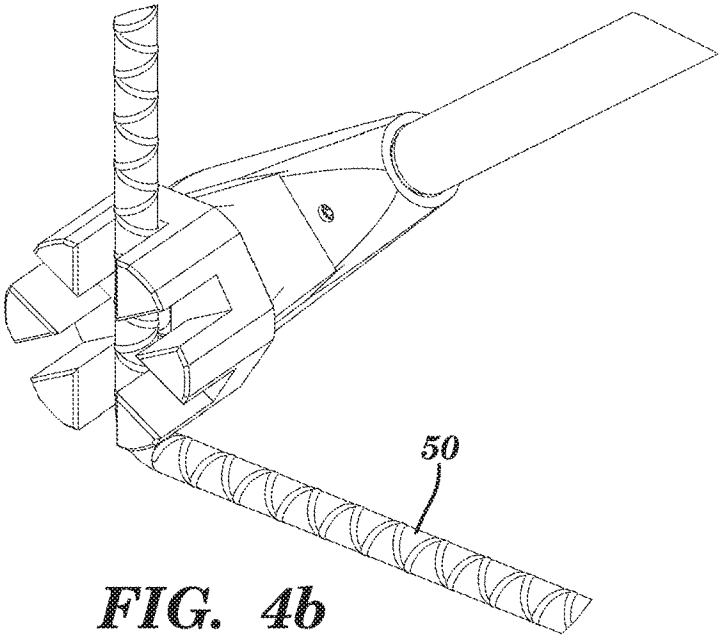
FIG. 4*b* is an enlarged view of the portion of FIG. 4*a* identified by line A-A in FIG. 4*a;*
Figure 4A:
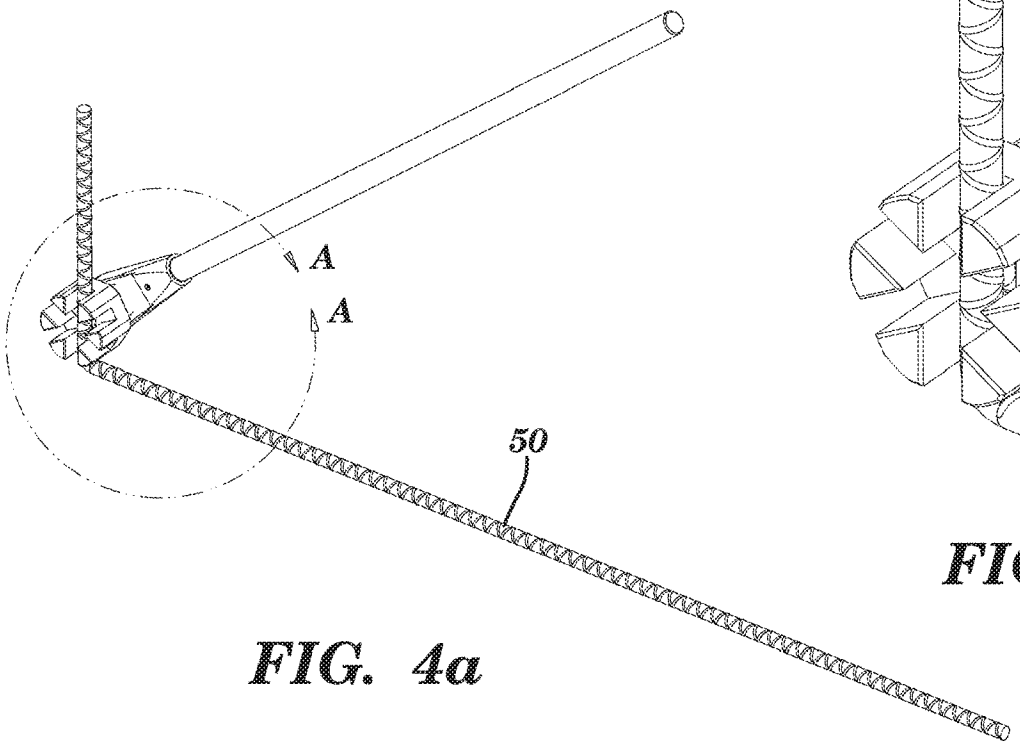
FIG. 4*a* is a perspective view of a Hickey bar of the present invention in operation bending a piece of rebar.

In the embodiment shown in FIGS. 3*a*-3*c*, the channel sides are opened to the top of the tool head so that the tool head may receive sideways insertion of rebar through the top of the tool head. The tool head may be positioned adjacent to a length of rebar at mid span, with the top of the head facing the side of the rebar and with a channel aligned with the rebar. The rebar and/or Hickey may then be moved sideways with respect to the rebar to insert the rebar into the channel, thus engaging the head and rebar for subsequent bending operations. FIGS. 4*a* and 4*b* show a Hickey bar of the present invention engaged with a rebar, shown after the bending operation has taken place.

The "sideways" directional reference for describing relative movement or special relationship of the tool and rebar indicates sideways with respect to the rebar.

In an alternate embodiment, the top side of the channel may be closed or have an undersized opening. In that case, the rebar may be received endwise through the side of the tool head into an open end of a channel. In this alternate embodiment, the bar is securely captured from unintended disengagement out from the top of the tool head during bending operations.

The tool head may comprise a plurality of channels. A channel may intersect one or more other channels. The embodiment of FIG. 3*c* comprises three channels, each having a different width than the other two, and all intersecting in the middle of the tool head. Channel widths may be sized to fit standard size rebar. For example, channels 41, 42 and 43 may be sized to fit three different standard sizes, such as standard bar sizes #5, #4, and #3, respectively. Channel widths may be sized to provide a clearance fit with the intended bar size diameter.

With further reference to FIGS. 1-3*b*, the tool head is provided with a square opening 44 for receiving square drive peg 25. Pin hole 36 is provided for alignment with a corresponding pin hole (not shown) in the drive peg and receiving a pin to securely affix the tool head to the drive peg. In a preferred embodiment, opening 44 is sized for compatibility with a one inch (1") square drive. Opening 44 may be sized for compatibility with other drive sizes. For example, it may be sized for compatibility with other standard drive sizes.

In other embodiments, opening 44 may be of any shape to correspond with the shape of the desired drive, such as any polygonal shape or splined shape.

In another embodiment, the tool head may be configured to be compatible with a female drive, such as a ratchet wrench with a female drive. In this embodiment, the base of the tool head may comprise a downward extension of polygonal cross section corresponding to the shape of the opening of the female drive. Said downward extension may be square, hexagonal, or any other shape to correspond with the shape of the desired drive, such as any standard size drive. The cross section may be of a splined shape.

The term "coupling" herein may refer to a male or female feature of the tool head for connecting with a corresponding female or male drive, respectively.

With reference to FIGS. 3*a*-3*c*, the external sides of base portion 31 may be engaged directly by a driving device. The hexagonal shape of the tool head of FIGS. 3*a*-3*c* is particularly suitable for such engagement. For example, an open ended wrench of appropriate size could engage the hexagonal shape.

In other embodiments, the bottom portion of the base may be provided in any shape to facilitate engagement with a driving device of desired shape.

A driving device may be any device suitable for attaching to and applying torque to the tool head.

In the embodiment of FIGS. 1-3*c*, channels 41, 42 and 43 intersect the drive axis of rotation. Thus, when the Hickey bar is in operational engagement with a length of rebar, the axis of rotation of the drive intersects the rebar. The drive axis of rotation is perpendicular to the longitudinal axis of rebar. This tool head configuration and geometric relationship between the Hickey bar and rebar provides efficiencies and advantages, such as mechanical advantages, operational advantages, tool design efficiencies, manufacturing efficiencies, space utilization advantages, and other advantages.

Two Hickey bars of the present invention may be used together to bend rebar by engaging the rebar at two locations and applying torque to each tool head in opposite directions.

A hickey bar of the present invention may comprise a handle attached to a ratchet attached to a tool head type shown in FIGS. 5*a*-6*b*, or any other tool head design adapted for engagement with and bending of rebar.

A kit of the present invention may comprise one or more a separate handles, ratchet mechanisms, tool heads and drive size adapters. Another kit may comprise one or more pre-assembled handle and tool head assemblies.

The device of the present invention may be used to engage and bend any long, slender, bendable object, such as threaded rods, grounding rods, and pipe.

While the invention has been particularly shown and described with reference to certain embodiments, it will be understood by those skilled in the art that various changes in form and details may be made to the invention without departing from the spirit and scope of the invention as described in the following claims.

I claim:

1. A hand tool for bending rebar, comprising:
- a ratchet mechanism;
- a handle extending from the ratchet mechanism; and
- a hickey tool head connected to the ratchet mechanism;
- said tool head comprising at least one engagement surface for engaging rebar, said at least one surface forming a space for receiving the rebar;
- wherein the angular position of the handle relative to the tool head is rotatable about an axis of rotation of the ratchet without disengaging the handle from the tool head; and
- wherein the axis of rotation of the ratchet mechanism intersects the space for receiving rebar.

2. The hand tool of claim 1 wherein the angular position is rotatable 360 degrees about said axis of rotation.

3. The hand tool of claim 1 wherein said space comprises a channel oriented transversely to the axis of rotation of the ratchet.

4. The hand tool of claim 1 wherein the connection between the ratchet mechanism and tool head is a releasable connection.

5. The hand tool of claim 1 wherein the mode of rotation of the ratchet mechanism drive is adjustable over a selection of modes comprising:
- locked in a clockwise and a counterclockwise directions;
- locked in a clockwise direction while free in a counterclockwise direction; and
- free in a clockwise direction while locked in a counterclockwise direction.

6. The hand tool of claim 1 wherein the ratchet mechanism comprises a male drive and the tool head is adapted for receiving the male drive to connect the ratchet mechanism and tool head together.

7. A hand tool for bending rebar, comprising:
- a ratchet mechanism;
- a handle extending from the ratchet mechanism; and
- a hickey tool head connected to the ratchet mechanism;
- said tool head comprising at least one engagement surface for engaging rebar, said at least one surface forming a space for receiving the rebar;
- wherein the angular position of the handle relative to the tool head is rotatable about an axis of rotation of the ratchet without disengaging the handle from the tool head; and
- wherein said space comprises a channel oriented transversely to the axis of rotation of the ratchet;
- wherein said channel intersects the axis of rotation of the ratchet.

8. A tool head for a rebar bending tool, comprising:
- a base adapted for attachment to a male drive, said base comprising an opening for receiving a male drive;
- at least one engagement surface for engaging rebar and transmitting torque to the rebar, said at least one surface forming a transverse space for receiving the rebar in a transverse orientation to a torque axis;

a plurality of spaced apart members extending upward from the base;

said members forming a plurality of transverse spaces for receiving rebar, wherein;

the plurality of spaces comprise a first space having a first width to fit over rebar of a first standard rebar diameter and second space having a second width to fit over rebar of a second standard rebar diameter.

9. The tool head of claim 8, wherein the opening is polygonal.

10. The tool head of claim 8, wherein at least two of the transverse spaces intersect each other.

11. The tool head of claim 10 wherein the plurality of transverse spaces comprise at least three transverse spaces that intersect each other.

12. The tool head of claim 11 wherein the at least three transverse spaces intersect at the center of the base.

13. The tool head of claim 8 wherein at least one of the extensions comprises at least one planar side surface for contacting the rebar.

14. A tool head for a rebar bending tool, comprising:

a base adapted for attachment to a female drive, said base comprising a male coupling configured for insertion into a female drive;

at least one engagement surface for engaging rebar and transmitting torque to the rebar, said at least one surface forming a transverse space for receiving the rebar in a transverse orientation to a torque axis;

a plurality of spaced apart members extending upward from the base;

said members forming a plurality of transverse spaces for receiving rebar, wherein:

the plurality of spaces comprise a first space having a first width to fit over rebar of a first standard rebar diameter and second space having a second width to fit over rebar of a second standard rebar diameter.

15. The tool head of claim 14, wherein the male coupling is polygonal.

16. A tool for bending rebar, comprising:

a base adapted for attachment to a driving device;

a plurality of spaced apart extensions extending from the base so as to form a plurality of transverse spaces for receiving rebar, wherein;

the plurality of spaces comprise a first space having a first width to fit over rebar of a first standard rebar diameter and second space having a second width to fit over rebar of a second standard rebar diameter;

a ratchet mechanism releasably attachable to the base; and a handle attached to the ratchet mechanism.

17. The tool of claim 16 wherein the ratchet mechanism comprises a male drive for engaging the base.

18. The tool of claim 16 wherein the ratchet mechanism comprises a female drive for engaging the base.

* * * * *